US010677118B2

(12) United States Patent
Miyajima et al.

(10) Patent No.: US 10,677,118 B2
(45) Date of Patent: Jun. 9, 2020

(54) THERMO VALVE AND OIL PUMP

(71) Applicant: YAMADA MANUFACTURING Co., Ltd., Kiryu-shi, Gunma (JP)

(72) Inventors: Junichi Miyajima, Kiryu (JP); Kazuo Shoji, Kiryu (JP); Soichi Yoshino, Kiryu (JP)

(73) Assignee: YAMADA MANUFACTURING CO., LTD., Kiryu-Shi (JP)

( * ) Notice: Subject to any disclaimer, the term of this patent is extended or adjusted under 35 U.S.C. 154(b) by 331 days.

(21) Appl. No.: 15/793,220

(22) Filed: Oct. 25, 2017

(65) Prior Publication Data

US 2018/0149050 A1 May 31, 2018

(30) Foreign Application Priority Data

Nov. 28, 2016 (JP) ..... 2016-230068
Feb. 1, 2017 (JP) ..... 2017-016734

(51) Int. Cl.
*F01M 1/16* (2006.01)
*F04C 14/24* (2006.01)
(Continued)

(52) U.S. Cl.
CPC ..... *F01M 1/16* (2013.01); *F01M 1/02* (2013.01); *F01M 1/20* (2013.01); *F04C 2/102* (2013.01);
(Continued)

(58) Field of Classification Search
CPC .. F01M 1/16; F01M 1/02; F01M 1/20; F01M 2001/0238; F04C 2/102; F04C 14/24;
(Continued)

(56) References Cited

U.S. PATENT DOCUMENTS 5,333,454 A * 8/1994 Nikaido ..... B62D 6/02 137/115.09
5,775,360 A * 7/1998 Hayashi ..... B62D 5/062 137/115.05
(Continued)

FOREIGN PATENT DOCUMENTS

DE 102010015152 A1 10/2011
DE 112013001039 T5 12/2014
(Continued)

OTHER PUBLICATIONS

Letter from Kroher/Strobel dated Nov. 14, 2018 commenting on German Search Report for German Patent Application No. 10 2017 124 864.1, 2 pages.
(Continued)

*Primary Examiner* — Michael A Riegelman
(74) *Attorney, Agent, or Firm* — Rankin, Hill & Clark LLP

(57) ABSTRACT

A thermo actuator includes an actuator body and a large-diameter portion (54) that projects from the actuator body outward in the radial direction. The outer diameter of a return spring is smaller than the inner diameter of a case. The outer diameter of the actuator body and the outer diameter of a valve body are smaller than the inner diameter of the return spring. The outer diameter of the large-diameter portion is smaller than the inner diameter of the case and is larger than the average diameter of the return spring. One end of the return spring is in contact with the large-diameter portion.

8 Claims, 7 Drawing Sheets

(51) Int. Cl.

| | |
|---|---|
| ***F01M 1/02*** | (2006.01) |
| ***F01M 1/20*** | (2006.01) |
| ***F04C 2/10*** | (2006.01) |
| ***F04C 14/26*** | (2006.01) |

(52) U.S. Cl.
CPC ..... *F04C 14/24* (2013.01); *F04C 14/26* (2013.01); *F01M 2001/0238* (2013.01); *F04C 2210/206* (2013.01); *F04C 2270/185* (2013.01); *F04C 2270/19* (2013.01); *F04C 2270/195* (2013.01); *F04C 2270/205* (2013.01)

(58) Field of Classification Search
CPC ..... F04C 14/26; F04C 2210/206; F04C 2270/185; F04C 2270/19; F04C 2270/195; F04C 2270/205
See application file for complete search history.

(56) References Cited

U.S. PATENT DOCUMENTS

| | | | | |
|---|---|---|---|---|
| 6,253,837 | B1 * | 7/2001 | Seiler | F16H 57/0413 137/625.29 |
| 8,141,790 | B2 * | 3/2012 | Sheppard | F01P 7/16 236/100 |
| 10,054,962 | B2 * | 8/2018 | Yajima | F16K 31/002 |
| 2008/0029246 | A1 * | 2/2008 | Fratantonio | F16H 57/0412 165/103 |
| 2014/0154119 | A1 * | 6/2014 | Izutsu | F04C 2/10 418/19 |
| 2014/0374495 | A1 * | 12/2014 | Malone | F01P 7/14 236/34.5 |
| 2015/0167667 | A1 * | 6/2015 | Miyajima | F04C 2/18 418/21 |
| 2015/0275714 | A1 * | 10/2015 | Lauria | F01M 5/002 123/196 AB |
| 2015/0377234 | A1 * | 12/2015 | Miyajima | F04C 14/24 417/297 |
| 2016/0090983 | A1 * | 3/2016 | Miyajima | F04C 14/226 418/16 |
| 2017/0044939 | A1 * | 2/2017 | Watanabe | F16K 17/0473 |
| 2017/0114682 | A1 * | 4/2017 | Miyajima | F04C 14/26 |
| 2017/0184204 | A1 * | 6/2017 | Ishibashi | F16K 31/1226 |
| 2017/0284243 | A1 * | 10/2017 | Miyajima | F01M 5/007 |
| 2018/0149050 | A1 * | 5/2018 | Miyajima | F04C 14/24 |
| 2018/0149273 | A1 * | 5/2018 | Shoji | F16K 11/0716 |
| 2019/0293200 | A1 * | 9/2019 | Miyajima | B23P 15/001 |

FOREIGN PATENT DOCUMENTS

| | | |
|---|---|---|
| DE | 102015211846 A1 | 12/2015 |
| JP | 2016-027253 | 2/2016 |

OTHER PUBLICATIONS

German Search Report dated Nov. 5, 2018, German Patent Application No. 10 2017 124.864.1, 9 pages.

* cited by examiner

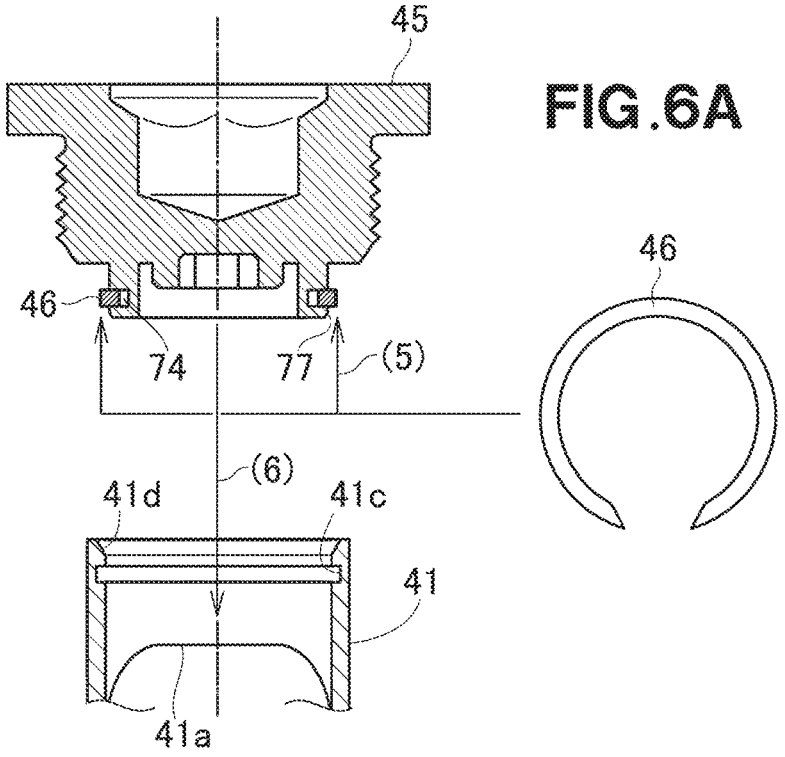
FIG.6A
FIG.6B
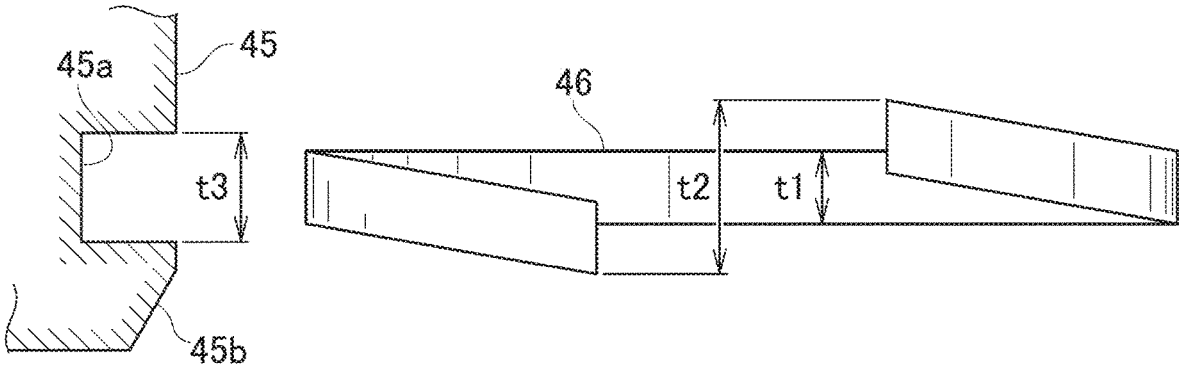

THERMO VALVE AND OIL PUMP

FIELD OF THE INVENTION

The present invention relates to a thermo valve and an oil pump equipped with the thermo valve.

BACKGROUND OF THE INVENTION

Oil that has flowed from an engine to an oil pan is forced to flow back to the engine by an oil pump, for example. In a flow passage (oil passage) in which oil circulates, a valve for controlling the flow rate of the oil may be used. One of the known valves is a thermo valve that operates in accordance with the temperature of the oil. A technique disclosed in Japanese Patent Application Laid-Open Publication (Kokai) No. 2016-27253 is an existing technique pertaining to thermo valves.

An oil flow passage in an engine such as the one described in Japanese Patent Application Laid-Open Publication No. 2016-27253 includes an engine, an oil pan to which oil that has passed through the engine flows, an oil pump for circulating the oil that has accumulated in the oil pan, a relief valve and a thermo valve for controlling the flow rate of the oil circulated by the oil pump, a main flow passage that connects the engine, the oil pan, and the oil pump and allows the oil to circulate therein, and a bypass flow passage that bypasses the main flow passage.

The thermo valve includes a thermo actuator that operates in accordance with the temperature of the oil, and the thermo actuator actuates the valve body. When the temperature of the oil is high, wax inside the thermo actuator expands to move the valve body forward. The valve body closes the bypass flow passage, and the oil flows only in the main flow passage. When the temperature of the oil is low, the wax inside the thermo actuator contracts. The valve body is retracted by the biasing force of a return spring inside the thermo actuator. Thus, the bypass flow passage opens. The oil flows in both the main flow passage and the bypass flow passage.

Oil is highly viscous at a low temperature. In other words, low-temperature oil has high oil pressure. If a portion of the low-temperature oil flows into the bypass flow passage, it becomes possible to keep the oil pressure inside the main flow passage to stay substantially constant regardless of the difference in the oil temperature.

There is a demand that components such as an engine and an oil pan be contained in a small compartment space. When the size of a thermo valve can be reduced, the degree of freedom in the arrangement of the components increases, and this is preferable.

SUMMARY OF THE INVENTION

One object of the present invention is to provide a compact thermo valve and an oil pump equipped with such a thermo valve.

According to one aspect of the present invention, there is provided a thermo valve that includes a thermo actuator that operates as a temperature of a fluid changes, a valve body that is fastened to the thermo actuator and that controls a flow rate of the fluid, a return spring that biases the thermo actuator and the valve body in a returning direction, and a case that houses the thermo actuator, the valve body, and the return spring.

The thermo actuator includes an actuator body and a large-diameter portion that projects from the actuator body outward in a radial direction.

An outer diameter of the return spring is smaller than an inner diameter of the case.

An outer diameter of the actuator body and an outer diameter of the valve body are smaller than an inner diameter of the return spring.

An outer diameter of the large-diameter portion is smaller than the inner diameter of the case and is larger than an average diameter of the return spring.

One end of the return spring is in contact with the large-diameter portion.

In the present invention, the outer diameter of the actuator body and the outer diameter of the valve body are smaller than the inner diameter of the return spring. The actuator body can be disposed within the inner periphery of the return spring, and the total length of the thermo valve can be reduced. In other words, the size of the thermo valve can be reduced. In addition, the actuator body and the valve body can be integrated and then housed inside the case. Therefore, the assembling of the thermo actuator can be facilitated.

Furthermore, the outer diameter of the large-diameter portion formed integrally with the actuator body is larger than the average diameter of the return spring, and one end of the return spring is in contact with the large-diameter portion. In other words, the large-diameter portion formed integrally with the actuator body receives the above-mentioned one end of the return spring. Since the large-diameter portion formed integrally with the actuator body receives the return spring, the size of the thermo valve can be reduced, as compared to the case in which the return spring is received by a separate component.

BRIEF DESCRIPTION OF THE DRAWINGS

Hereinafter, some exemplary embodiments of the present invention will be described in detail with reference to the accompanying drawings, in which:

FIG. 6A is a view useful to describe an actuator lid portion mounting process of the thermo valve illustrated in FIG. 3A;

FIG. 6B is a view useful to describe the details of the actuator lid portion illustrated in FIG. 6A.

DETAILED DESCRIPTION OF THE PREFERRED EMBODIMENTS

Figure 1:
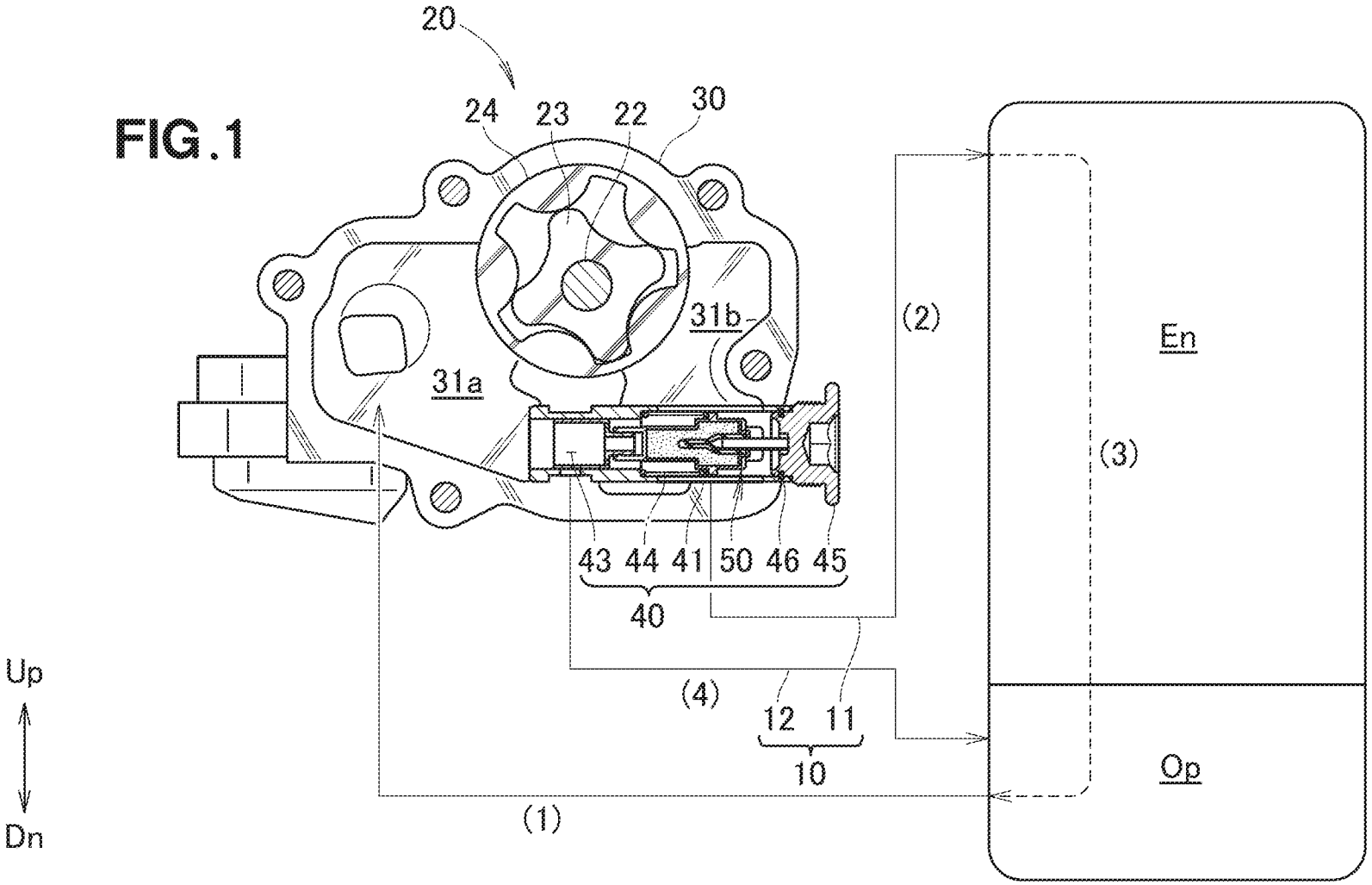
FIG. 1 is circuit diagram of an oil flow passage when an oil pump of a first embodiment of the present invention is employed.

Embodiments of the present invention will be described with reference to the accompanying drawings. In the description, the terms "up," "down," "right" and "left" indicate the up, down, right, and left directions within the drawings. In addition, in the drawings, "Up" represents upward, and "Dn" represents downward.

First Embodiment

Referring to FIG. 1, an oil pump 20 is used in an oil flow passage 10. For example, the oil flow passage 10 is a flow passage that connects an oil pan Op to the oil pump 20 and connects the oil pump 20 to an engine En to allow oil to circulate therein.

The oil flow passage 10 includes a main flow passage 11 and a bypass flow passage 12 that bypasses a portion of the main flow passage 11.

The oil pump 20 is a so-called internal gear pump. The oil pump 20 includes a housing 30, a rotating shaft portion 22 that is disposed in the housing 30 and configured to rotate as the engine En operates, an inner rotor 23 that is disposed in the housing and configured to be rotated by the rotating shaft portion 22, an outer rotor 24 (oil feeding unit 24) that is disposed in the housing to enclose the periphery of the inner rotor 23 and configured to be rotated by the inner rotor 23, and a thermo valve 40 that is disposed in the housing and configured to operate in accordance with the temperature of the oil.

The rotating shaft portion 22 is connected to a crankshaft directly or with a chain or a gear interposed therebetween, for example. The rotating shaft portion 22 can be connected to a desired member, such as a camshaft, aside from the crankshaft. In other words, an external driving source is not limited to a crankshaft.

The thermo valve 40 is disposed along a horizontal axis underneath the lower end of the outer rotor 24. An end portion of the thermo valve 40 is located underneath the rotating shaft portion 22 as viewed from the front. The expression "as viewed from the front" refers to a view in which the oil pump 20 is viewed along the axial direction of the rotating shaft portion 22.

Figure 2:
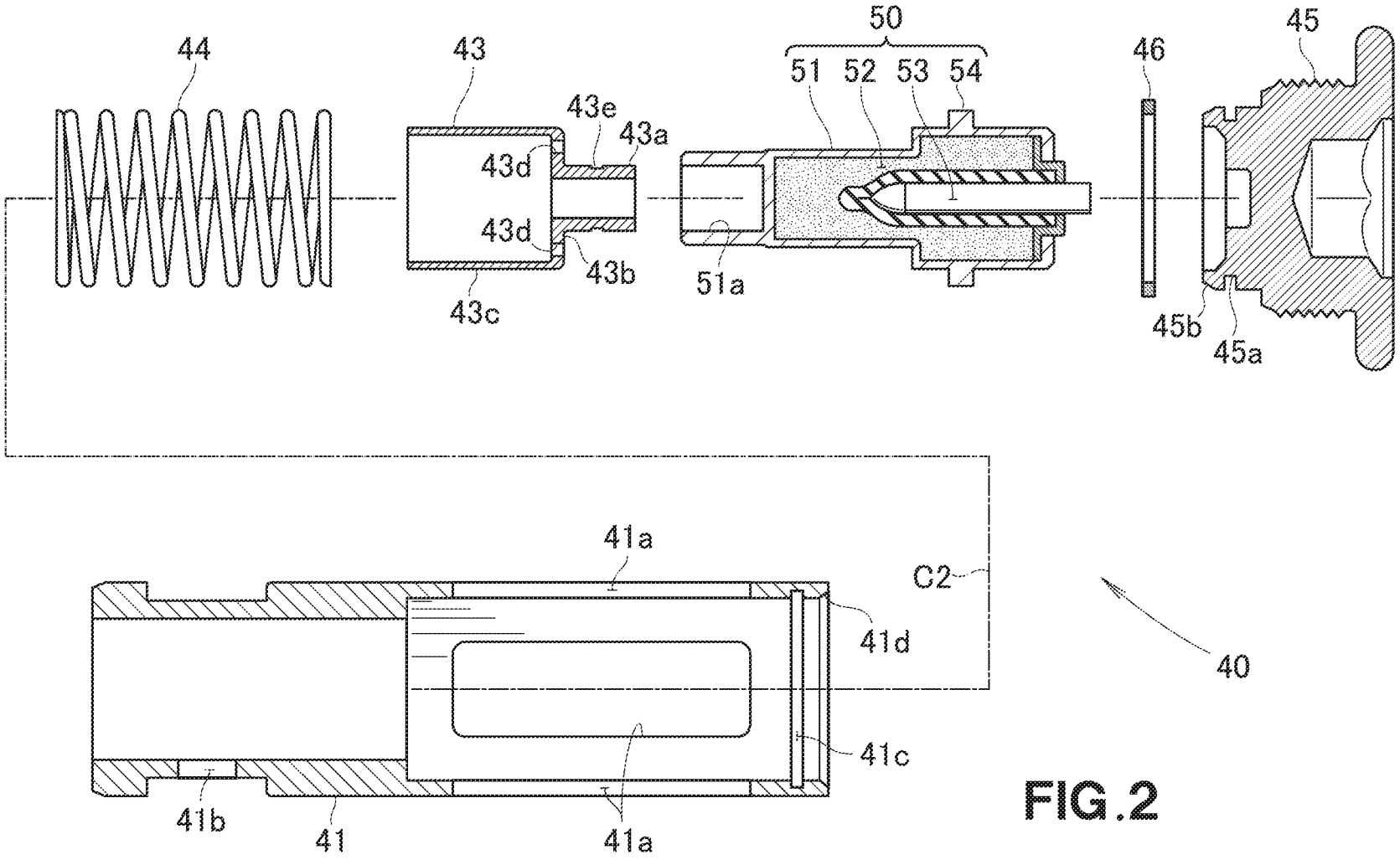
FIG. 2 is an exploded view of a thermo valve illustrated in FIG. 1.
Figure 3A:
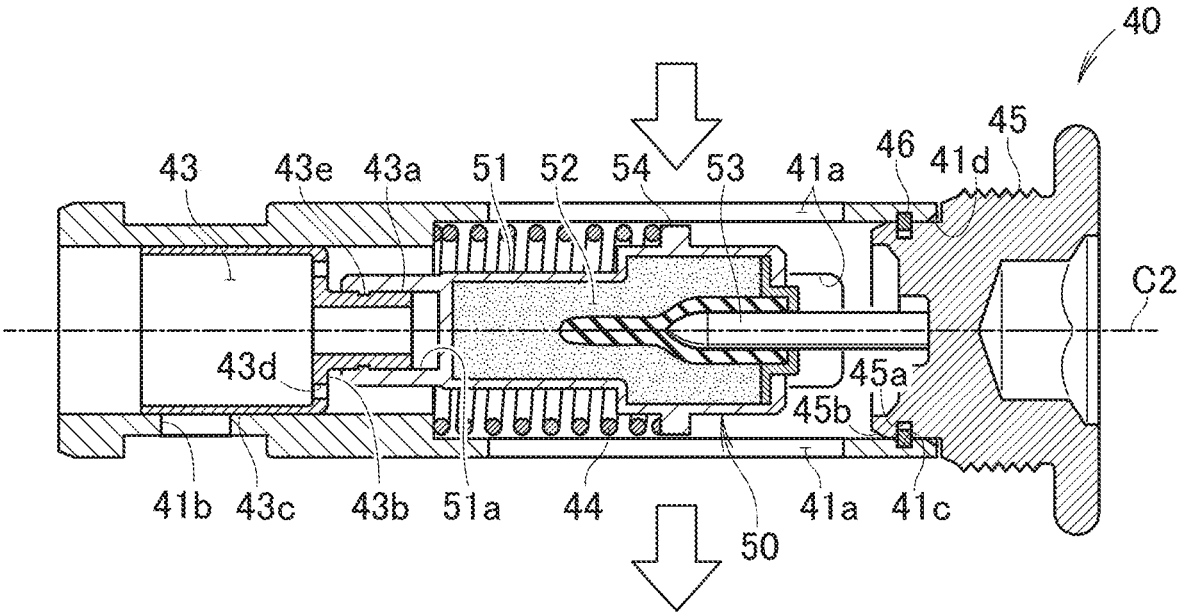
FIG. 3A is a view useful to describe an operation when high-temperature oil is flowing along the periphery of the thermo valve illustrated in FIG. 2.

FIG. 2 and FIG. 3A are referred to. FIG. 3A illustrates the thermo valve 40 when the temperature of the oil is high. The thermo valve 40 includes a thermo actuator 50 that operates in accordance with the temperature of the oil, a valve body 43 that is fastened to the thermo actuator 50, a return spring 44 that biases the thermo actuator 50 and the valve body 43 in a returning direction, and a substantially cylindrical case 41 that houses the thermo actuator 50, the valve body 43, and the return spring 44. One end of the case 41 is closed by an actuator lid portion 45. The actuator lid portion 45 is prevented from coming off the case 41 by a C-shaped retaining ring 46 interposed between the actuator lid portion 45 and the case 41.

The case 41 includes two or four window portions 41*a* formed in the outer periphery of the thermo actuator 50, a case hole portion 41*b* that is opened and closed by the valve body 43, and a retaining ring receiving groove 41*c* in which the C-shaped retaining ring 46 is received. The window portions 41*a* constantly allow the oil to pass therethrough while the oil is circulating. The portion of the case 41 in which the case hole portion 41*b* is formed and therearound is formed to be thinner across the entire circumference in the circumferential direction so that the outer diameter of that portion is smaller than the outer diameter of the remaining portion. Thus, the oil can be discharged smoothly regardless of the phase of the case hole portion 41*b*.

The thermo actuator 50 includes an actuator body 51, a wax 52 that is charged in a hole formed at one end of the actuator body 51 and that expands as the temperature rises, a rod 53 that is extruded from the actuator body 51 as the wax 52 expands, and a large-diameter portion 54 that projects from the actuator body 51 outward in the radial direction. The large-diameter portion 54 receives an end portion of the return spring 44 and functions as a spring bearing seat.

The valve body 43 includes a valve small-diameter portion 43*a* that is inserted and fastened in a hole 51*a* formed in another end of the actuator body 51, a valve step portion 43*b* that extends from an end portion of the valve small-diameter portion 43*a* toward the outer periphery, and a valve large-diameter portion 43*c* that extends from the outer end portion of the valve step portion 43*b* and that has a diameter larger than that of the valve small-diameter portion 43*a*. The valve body 43 may be fastened to the rod 53.

The valve step portion 43*b* has an oil passing hole portion 43*d* through which the oil can pass. Referring to FIG. 2 in particular, a groove portion 43*e* is formed in the valve small-diameter portion 43*a*. In addition, a through-hole is formed in the valve small-diameter portion 43*a*, penetrating its center along the axis. This allows the valve body 43 to be inserted into the hole 51*a* easily with little resistance of the air.

It should be noted that the groove portion 43*e* may be formed in the inner periphery of the actuator body 51. In addition, the leading end of the actuator body 51 may be inserted within the inner periphery of the valve small-diameter portion 43*a*. In this case, the groove portion 43*e* is formed in the inner periphery of the valve small-diameter portion 43*a* or in the outer periphery of the actuator body 51.

A retaining ring receiving groove 45*a* is formed in the leading end portion (the lower end portion in FIG. 2) of the actuator lid portion 45, and the C-shaped retaining ring 46 is received in the retaining ring receiving groove 45*a*.

The outer diameter of the valve large-diameter portion 43*c* is slightly smaller than the inner diameter of the case 41. The inner diameter of the case 41 is larger on the periphery of the large-diameter portion 54 and smaller on the periphery of the valve body 43. The portion that connects the two different diameters is formed in a step shape and receives the end portion of the return spring 44 to function as a spring bearing seat.

The operation of the oil pump 20 will be described.

Referring to FIG. 1, the oil pump 20 operates as the engine En operates. When the oil pump 20 operates, the oil that has accumulated in the oil pan Op flows toward the oil pump 20, as indicated by the arrow (1). Then, the oil passes through the inner rotor 23 and the outer rotor 24 and is discharged to the outside of the oil pump 20. The discharged oil is caused to return to the engine En, as indicated by the arrow (2). Then, the oil that has circulated in the engine En accumulates in the oil pan Op, as indicated by the arrow (3).

Referring also to FIG. 3A, the wax 52 expands when the temperature of the oil is high. As the wax 52 expands, the rod 53 receives the force in the direction in which the rod 53 goes out from the actuator body 51. However, the leading end of the rod 53 is in contact with the actuator lid portion 45, and thus the rod 53 is prevented from moving forward.

Therefore, the actuator body 51 is relatively retracted toward the left side of the figure against the biasing force of the return spring 44. In other words, the forward movement of the rod 53 refers to its movement relative to the actuator body 51. When the rod 53 has moved forward (the actuator body 51 is being retracted), the valve body 43 covers the case hole portion 41*b*. Therefore, the oil passes only through the window portions 41*a*. Thus, the oil flows only in the main flow passage 11 and does not flow into the bypass flow passage 12.

Figure 3B:
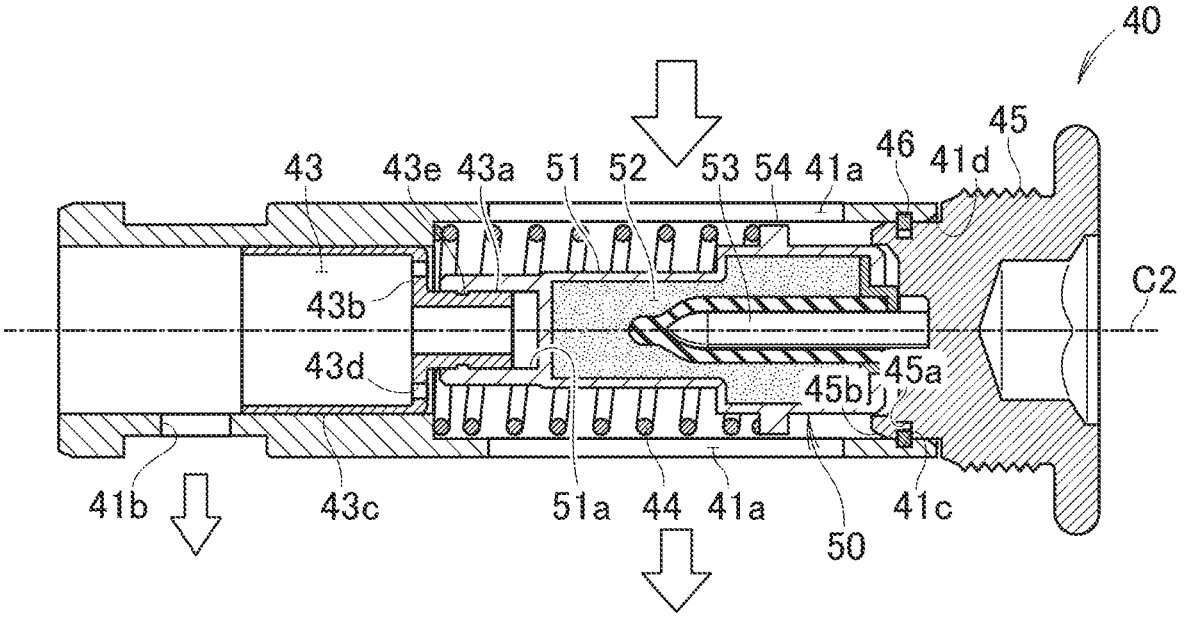
FIG. 3B is a view useful to describe an operation when low-temperature oil is flowing along the periphery of the thermo valve illustrated in FIG. 2.

FIG. 1 and FIG. 3B are now referred to. FIG. 3B illustrates the thermo valve 40 when the temperature of the oil is low. The temperature of the oil is low, for example, immediately after the engine is started. When the temperature of the oil is low, the wax 52 is in contraction. Due to the biasing force of the return spring 44, the actuator body 51 receives the force in the direction toward the right side of the figure. Thus, the amount by which the rod 53 projects from the actuator body 51 is reduced. In other words, the rod 53 is being more retracted when the temperature of the oil is low than when the temperature of the oil is high. Thus, the valve body 43 releases the case hole portion 41*b*.

When the case hole portion 41*b* is in a released condition, a portion of the oil flows between the return spring 44 and the actuator body 51 and passes through the oil passing hole portion 43*d*. The oil that has passed through the oil passing hole portion 43*d* is returned to the oil pan Op via the bypass flow passage 12, as indicated by the arrow (4) in FIG. 1. In other words, some of the oil is not returned to the engine En. Therefore, the flow rate of the oil that passes through the main flow passage 11 is reduced, and the rise in the oil pressure in the engine En can be suppressed.

A method of manufacturing the thermo valve 40 will be described.

Referring to FIG. 2, the case 41, the thermo actuator 50, the valve body 43, the return spring 44, the actuator lid portion 45, and the C-shaped retaining ring 46 are prepared (preparation step).

Figure 4C:
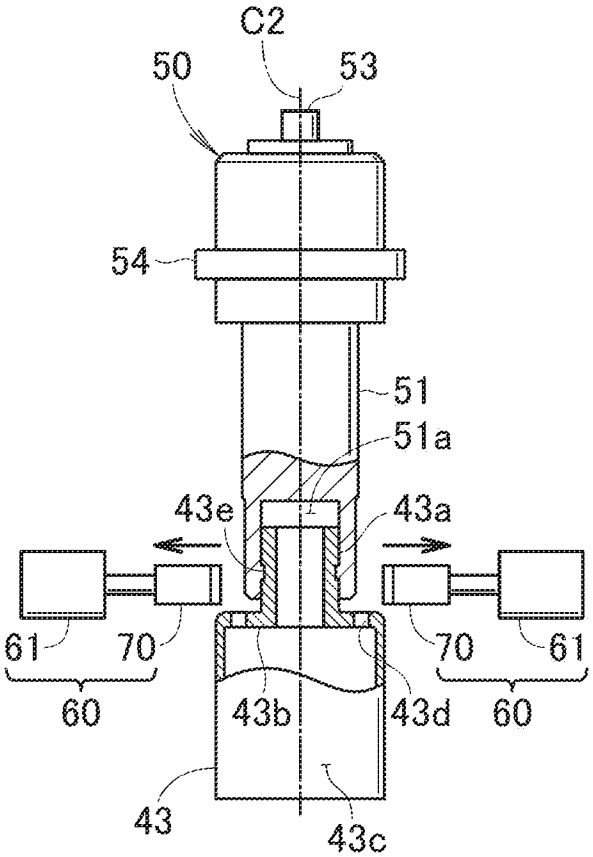
FIG. 4C is a view useful to describe a state after the caulking process of the thermo valve illustrated in FIG. 3A.
Figure 4B:
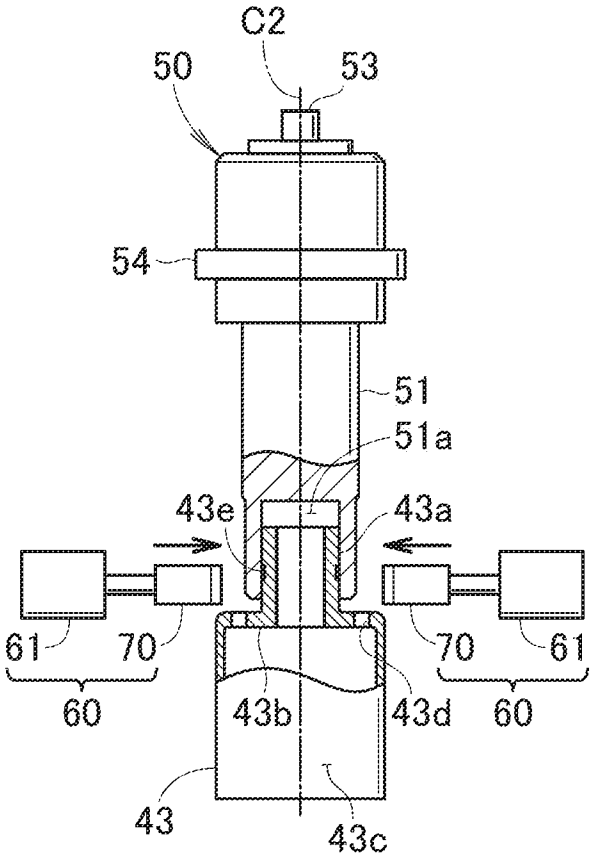
FIG. 4B is a view useful to describe a state prior to a caulking process of the thermo valve illustrated in FIG. 3A.
Figure 4A:
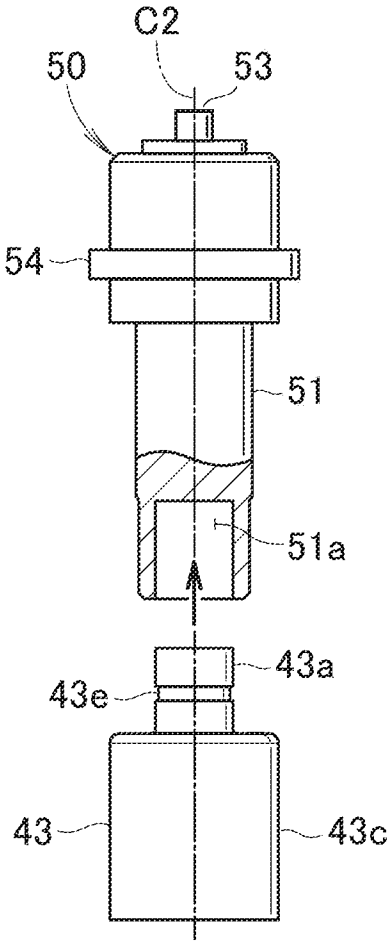
FIG. 4A is a view useful to describe an overlaying process of the thermo valve illustrated in FIG. 3A.

Referring to FIG. 4A, the valve body 43 is overlaid with the thermo actuator 50 such that the groove portion 43*e* is covered (overlaying step). To rephrase, the valve body 43 is inserted into the actuator body 51 until the groove portion 43*e* is in the actuator body 51.

Referring to FIG. 4B, a jig 60 is brought close to the groove portion 43*e* to fasten the valve body 43 to the thermo actuator 50.

The jig 60 is constituted by an actuator 61 and a pressurizing member 70, supported by the actuator 61, for pressurizing the valve body 43 or the thermo actuator 50.

Referring to FIG. 4C, the actuator body 51 is pressurized toward an axis C2 from the outer periphery by the pressurizing member 70. In other words, the valve body 43 and the thermo actuator 50 are pressurized toward the axis C2 from their outer sides in the radial direction, and thus the portion of the valve body 43 that is to be attached to the thermo actuator 50 is caulked (caulking step).

Figure 5B:
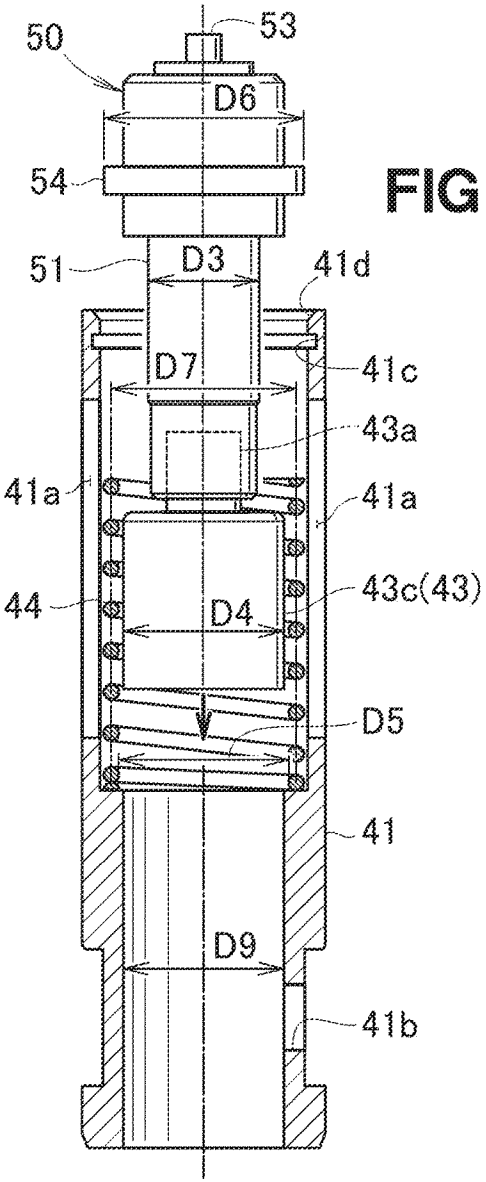
FIG. 5B is a view useful to describe a thermo actuator insertion process of the thermo valve illustrated in FIG. 3A.
Figure 5A:
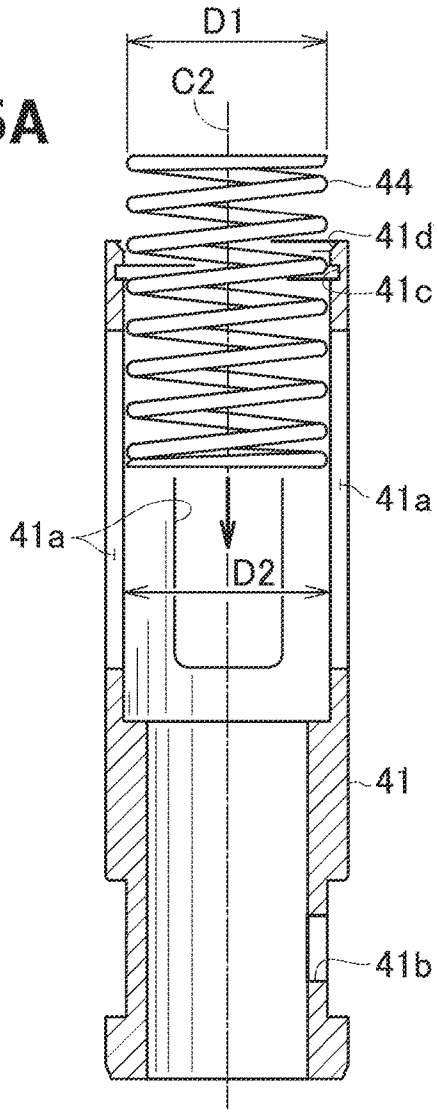
FIG. 5A is a view useful to describe a return spring insertion process of the thermo valve illustrated in FIG. 3A.

Referring to FIG. 5A, the return spring 44 is inserted into the case 41 (return spring insertion step). The outer diameter D1 of the return spring 44 is smaller than the inner diameter D2 of the case 41.

Referring to FIG. 5B, the thermo actuator 50 to which the valve body 43 is fastened is inserted into the case 41 in which the return spring 44 is inserted (thermo actuator insertion step). The outer diameter D3 of the actuator body 51 and the outer diameter D4 of the valve body 43 are smaller than the inner diameter D5 of the return spring 44. The outer diameter D6 of the large-diameter portion 54 is smaller than the inner diameter D2 of the case 41 and is larger than the average diameter (the center diameter) D7 of the return spring 44, which is the diameter passing through the center of the wire rod of the return spring 44.

The inner diameter D9 of the case 41 at a portion where the case hole portion 41*b* is formed is larger than the outer diameter D4 of the valve body 43 and is smaller than the average diameter D7 of the return spring 44. The return spring 44 can be received by the step formed inside the case 41 while the movement of the valve body 43 is permitted.

As illustrated in FIG. 6B, a male taper portion 45*b* that becomes narrower toward the leading end is formed in the actuator lid portion 45 below the retaining ring receiving groove 45*a*. Thus, the C-shaped retaining ring 46 is pushed along the male taper portion 45*b*, as indicated by the arrow (5). The diameter of the C-shaped retaining ring 46 is enlarged by the male taper portion 45*b*. When the C-shaped retaining ring 46 is further pushed, the C-shaped retaining ring 46 fits into the retaining ring receiving groove 45*a*.

A female taper portion 41*d* that becomes broader toward the leading end is formed in the case 41 above the retaining ring receiving groove 41*c*. When the actuator lid portion 45 is inserted into the case 41, as indicated by the arrow (6), the diameter of the C-shaped retaining ring 46 is reduced by the female taper portion 41*d*. When the actuator lid portion 45 is further inserted, the C-shaped retaining ring 46 fits in the retaining ring receiving groove 41*c*. Thus, the actuator lid portion 45 is fixed to the end portion of the case 41.

FIG. 6B is now referred to. FIG. 6B is a supplementary illustration of FIG. 6A. As illustrated in FIG. 6B, the C-shaped retaining ring 46 has a spring washer shape. When the thickness of the C-shaped retaining ring 46 (corresponding to the spring solid length, i.e., the thickness of the wire rod) is t1, the spring free length is t2, and the groove width of the retaining ring receiving groove 45*a* is t3, then the relationships of $t1<t3$ and $t1<t2$ hold.

Specifically, the groove width t3 is preferably 1.05 to 1.4 times the thickness t1 of the circlip, and the spring free length t2 is greater than the thickness (the spring solid length) t1 although there may be a difference depending on the manufacturing plan.

The above-described embodiment provides the following advantageous effects.

The outer diameter D3 of the actuator body 51 and the outer diameter D4 of the valve body 43 are smaller than the inner diameter D5 of the return spring 44. The actuator body 51 can be disposed within the inner periphery of the return spring 44, and the total length of the thermo valve 40 can be reduced. In other words, the size of the thermo valve 40 can be reduced. In addition, the actuator body 51 and the valve body 43 can be integrated and then housed inside the case 41. Therefore, the assembling of the thermo actuator 50 can be facilitated.

Furthermore, the outer diameter D6 of the large-diameter portion 54 formed integrally with the actuator body 51 is larger than the average diameter D7 of the return spring 44, and one end of the return spring 44 is in contact with the large-diameter portion 54. In other words, the large-diameter portion 54 formed integrally with the actuator body 51 receives the one end of the return spring 44. Since the large-diameter portion 54 formed integrally with the actuator body 51 receives the return spring 44, the size of the thermo valve 40 can be reduced, as compared to the case in which the return spring 44 is received by a separate component.

Second Embodiment

A second embodiment of the present invention will now be described with reference to the drawing.

Figure 7:
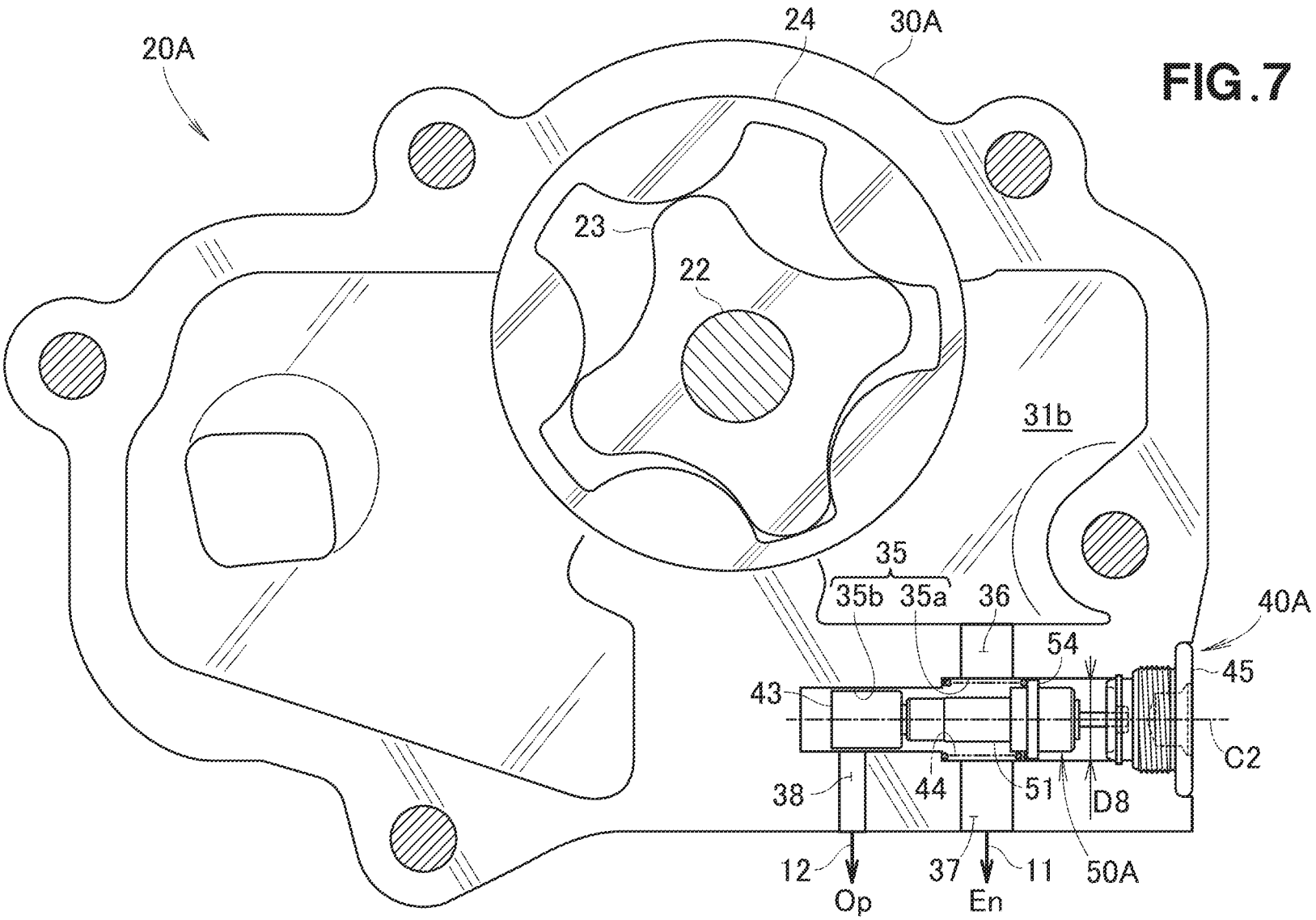
FIG. 7 is a cross-sectional view of an oil pump according to a second embodiment of the present invention.

FIG. 7 illustrates an oil pump 20A according to the second embodiment. In the oil pump 20A according to the second embodiment, a case of a thermo actuator 50A is constituted by a hole portion 35 formed in a housing 30A. In other words, the inner diameter D2 of the case 41 can be replaced with the inner diameter D8 of the hole portion 35. Other basic configurations are common to those of the oil pump and the thermo actuator according to the first embodiment. Portions that are common to those of the first embodiment are given the same reference numerals, and detailed descriptions thereof will be omitted.

The hole portion 35 includes an actuator body housing portion 35*a* that primarily houses the thermo actuator body 51 and a valve housing portion 35*b* that primarily houses the valve body 43 while allowing the valve body 43 to move therein. The actuator body housing portion 35*a* has a diameter larger than that of the valve housing portion 35*b*. The portion that connects the diameter of the actuator body housing portion 35*a* to the diameter of the valve housing portion 35*b* is formed into a step shape. This step portion receives the return spring 44.

The housing 30A includes, aside from the hole portion 35, a first housing flow passage hole 36 that connects a discharge port 31*b* to the hole portion 35, a second housing flow passage hole 37 formed to extend from the hole portion 35 to the outer peripheral surface of the housing 30A, and a third housing flow passage hole 38 that is formed to extend from the hole portion 35 to the outer peripheral surface of the housing 30A and that is opened and closed by the valve body 43.

The oil discharged from the second housing flow passage hole 37 is guided to the engine. In other words, the second housing flow passage hole 37 is connected to the main flow passage 11. The oil discharged from the third housing flow passage hole 38 is guided to the oil pan Op. In other words, the third housing flow passage hole 38 is connected to the bypass flow passage 12.

The first housing flow passage hole 36 and the second housing flow passage hole 37 are formed linearly to be continuous with each other with the hole portion 35 interposed therebetween. The two flow passages can be formed in a single instance of boring or drilling.

The above-described second embodiment of the present invention also provides the predetermined advantageous effects of the present invention. The second embodiment of the present invention further provides the following advantageous effects.

The case of the thermo valve 40A is constituted by the hole portion 35 formed in the housing 30A. In other words, the thermo valve 40A is provided integrally with the oil pump 20A. The size can be reduced as a whole, as compared to the case in which the thermo valve 40A and the oil pump 20A are provided separately. In addition, the housing 30A is used as the case of the thermo valve 40A. The housing 30A has a high strength, and thus high mounting rigidity of the thermo valve 40 can be ensured.

One end of the return spring 44 is received by the step portion of the hole portion 35. Since a portion of the housing 30A is used, the return spring 44 can be received reliably without increasing the number of components.

It should be noted that although the oil pump according to the present invention has been described with an example of circulating oil in an automobile engine, the oil pump can be provided in vehicles other than automobiles and can also be employed in structures and the like other than vehicles. The oil pump can be applied to any structure in which a thermo valve controls the flow rate of oil into a bypass flow passage in accordance with the temperature of the oil, and the present invention is not limited to the above-described embodiments.

It should also be noted that although the oil pump equipped with the thermo actuator has been described with an example of an internal gear pump, the thermo actuator according to the present invention can also be provided in an external gear pump or a vane pump, and the predetermined advantageous effects of the present invention can be obtained. In other words, any suitable oil feeding unit may be used as long as the oil feeding unit can feed oil, and the oil feeding unit is not limited to an inner rotor or an outer rotor.

In particular, even in the case of an external gear pump or a vane pump, when the thermo actuator is disposed orthogonally to an oil passage, the same advantageous effects as those obtained in the case in which the thermo valve is disposed orthogonally to an oil passage of an internal gear pump are obtained.

It should also be noted that the housing of the oil pump may be formed integrally with a chain case or a balancer housing through a manufacturing process such as casting. In other words, the oil pump according to the present invention also includes those formed integrally with a chain case or a balancer housing. Therefore, the oil pump need not be provided separately from a chain case or a balancer housing.

An oil pump formed integrally with a chain case or a balancer housing is not limited to an internal gear pump.

In other words, the present invention is not limited to the embodiments as long as the functions and the advantageous effects of the present invention are obtained.

The oil pump according to the present invention is suitable for circulating oil in an automobile engine.

20, 20A: Oil pump
22: Rotating shaft portion
23: Inner rotor (oil feeding unit)
24: Outer rotor (oil feeding unit)
30, 30A: Housing
35: Hole portion
40: Thermo valve
41: Case
43: Valve body
44: Return spring
50, 50A: Thermo actuator
51: Actuator body
54: Large-diameter portion
D1: Outer diameter of the return spring
D2: Inner diameter of the case
D3: Outer diameter of the actuator body
D4: Outer diameter of the valve body
D5: Inner diameter of the return spring
D6: Outer diameter of the large-diameter portion
D7: Average diameter (center diameter) of the return spring

What is claimed is:

1. A thermo valve comprising:

a thermo actuator that operates as a temperature of a fluid changes;

a valve body that is fastened to the thermo actuator and controls a flow rate of the fluid;

a return spring that biases the thermo actuator and the valve body in a returning direction; and a case that houses the thermo actuator, the valve body, and the return spring, the thermo actuator including an actuator body and a large-diameter portion that projects from the actuator body outward in a radial direction, the case has a relatively larger inner diameter on a periphery of the larger-diameter portion and a relatively smaller inner diameter on a periphery of the valve body, a portion of the case connecting the larger inner diameter to the smaller inner diameter is formed in a step shape, an outer diameter of the return spring is smaller than an inner diameter of the periphery of the larger-diameter portion, an outer diameter of the actuator body and an outer diameter of the valve body being smaller than an inner diameter of the return spring, an outer diameter of the large-diameter portion is smaller than the inner diameter of the periphery of the larger-diameter portion and larger than an average diameter of the return spring, one end of the return spring is in contact with the large-diameter portion, an other end of the return spring is in contact with the case portion having the step shape.

2. The thermo valve according to claim 1, wherein the case includes a case hole portion that allows oil to pass therethrough and that is opened and closed by the valve body, and an inner diameter of the case at a portion where the case hole portion is formed is larger than the outer diameter of the valve body and is smaller than the average diameter of the return spring.

3. The thermo valve according to claim 1, wherein the case includes a case hole portion that allows oil to pass therethrough and that is opened and closed by the valve body, and an outer diameter of the case at a portion where the case hole portion is formed is smaller than an outer diameter of the case at other portions in a circumferential direction.

4. The thermo valve according to claim 1, wherein the valve body is fastened to the actuator body.

5. An oil pump equipped with the thermo valve according to claim 1, wherein a housing of the oil pump has a hole portion formed therein, and the case of the thermo valve is constituted by the hole portion formed in the housing.

6. An oil pump provided with the thermo valve according to claim 1, wherein a housing of the oil pump houses a rotating shaft portion and oil feeding units that are rotated by the rotating shaft portion to feed oil, and the thermo valve is disposed along a horizontal axis at a position underneath the rotating shaft portion.

7. The oil pump according to claim 6, wherein at least a portion of the thermo valve is located directly underneath the rotating shaft portion as viewed from a front.

8. An oil pump comprising:

a housing that has a hole portion formed therein;

a case that is constituted by the hole portion formed in the housing;

a thermo actuator that operates as a temperature of a fluid changes;

a valve body that is fastened to the thermo actuator and controls a flow rate of the fluid; and a return spring that biases the thermo actuator and the valve body in a returning direction, the case that houses the thermo actuator, the valve body, and the return spring, the thermo actuator includes an actuator body and a large-diameter portion that projects outward from the actuator body in a radial direction, an outer diameter of the return spring being smaller than an inner diameter of the case, an outer diameter of the actuator body and an outer diameter of the valve body being smaller than an inner diameter of the return spring, an outer diameter of the large-diameter portion being smaller than the inner diameter of the case and being larger than an average diameter of the return spring, one end of the return spring being in contact with the large-diameter portion, the hole portion includes an actuator body housing portion, which houses the actuator body, and a valve housing portion, which houses the valve body while allowing the valve body to move therein, an inner diameter of the actuator body housing portion is larger than an inner diameter of the valve housing portion, and a portion that connects a diameter of the actuator body housing portion to a diameter of the valve housing portion having a step shape, and the portion having the step shape receives an other end of the return spring.

* * * * *